US005934312A

United States Patent [19]

Bellenger et al.

[11] Patent Number: 5,934,312

[45] Date of Patent: Aug. 10, 1999

[54] DROP CHUTE SPILL GUARD

[75] Inventors: David C. Bellenger, Tuscaloosa; Danny Lee Smith, Cottondale, both of Ala.

[73] Assignee: Spillguard Development LLC, Tuscaloosa, Ala.

[21] Appl. No.: 08/831,596

[22] Filed: Apr. 10, 1997

[51] Int. Cl.[6] ..... B65B 3/06; B67D 5/00

[52] U.S. Cl. ..... 137/312; 141/86; 220/571; 222/108

[58] Field of Search ..... 137/312, 377; 220/571, 573; 222/108; 141/86; 184/106

[56] References Cited

U.S. PATENT DOCUMENTS

| | | | |
|---|---|---|---|
| Re. 31,087 | 11/1982 | Sohl . | |
| 1,805,729 | 5/1931 | Tallon | 184/106 |
| 3,329,231 | 7/1967 | Takenouchi | 137/312 |
| 4,031,839 | 6/1977 | Pedone . | |
| 4,313,457 | 2/1982 | Cliff | 137/312 |
| 4,450,855 | 5/1984 | Hills | 137/312 |
| 4,497,147 | 2/1985 | Clapper et al. . | |
| 4,683,850 | 8/1987 | Bauder | 184/106 |
| 4,737,394 | 4/1988 | Zafiroglu . | |
| 4,798,754 | 1/1989 | Tomek | 184/106 |
| 4,809,734 | 3/1989 | Cliff | 137/312 |
| 4,818,151 | 4/1989 | Moreland . | |
| 4,889,155 | 12/1989 | Trotter, Sr. | 137/312 |
| 4,896,705 | 1/1990 | Podgers et al. | 141/86 |
| 4,965,129 | 10/1990 | Bair et al. . | |
| 5,128,189 | 7/1992 | Bartlett | 184/106 |
| 5,186,831 | 2/1993 | DePetris . | |
| 5,261,773 | 11/1993 | Thomas | 141/86 |
| 5,329,974 | 7/1994 | Paping | 141/86 |
| 5,364,535 | 11/1994 | Buckalew . | |
| 5,419,945 | 5/1995 | Lopez | 184/106 |
| 5,435,458 | 7/1995 | Bishop | 137/312 |
| 5,478,625 | 12/1995 | Wright | 184/106 |
| 5,492,881 | 2/1996 | Diamond . | |
| 5,500,267 | 3/1996 | Canning . | |
| 5,501,243 | 3/1996 | Palazzo | 141/86 |
| 5,518,797 | 5/1996 | Holland . | |
| 5,526,900 | 6/1996 | Mason | 141/86 |
| 5,547,312 | 8/1996 | Schmitz | 137/312 |
| 5,547,313 | 8/1996 | Holland . | |
| 5,549,178 | 8/1996 | Yuhas | 141/86 |
| 5,566,731 | 10/1996 | Holland . | |
| 5,567,259 | 10/1996 | Gregory et al. . | |
| 5,738,139 | 4/1998 | DeChard | 141/86 |
| 5,775,869 | 7/1998 | Bishop | 137/312 |
| 5,819,819 | 10/1998 | Stanley | 141/86 |

*Primary Examiner*—George L. Walton
*Assistant Examiner*—Bryan Wallace
*Attorney, Agent, or Firm*—Nixon & Vanderhye P.C.

[57] ABSTRACT

A drop chute spill guard contains spills in conjunction with a loading hose supplying fuel to an in-ground storage tank. The spill guard includes a flexible barrier sized to surround the sump, an absorption layer disposed covering the flexible barrier, and a sealing ring with a stiffener ring secured to the flexible barrier and having an outside diameter substantially corresponding to a diameter of the sump. An opening is disposed in the vicinity of the tank inlet and extends through the absorption layer, the flexible barrier, the sealing ring, and the stiffener ring for receiving the drop chute. The arrangement provides effective spill containment with a portable apparatus. The absorption layers are easily replaced in the event of contamination, and the sealing ring is provided with a stepped outside diameter to accommodate varying sump diameters.

23 Claims, 5 Drawing Sheets

DROP CHUTE SPILL GUARD

BACKGROUND OF THE INVENTION

The present invention relates to an apparatus for containing accidental drips and spills of fuels at environmentally sensitive areas and, in particular, to a drop chute spill guard for containing spills in conjunction with a loading hose supplying fuel to an in-ground storage tank via a drop chute.

Facilities having in-ground fuel storage tanks include marinas, tugboat fueling depots, airports, truck stops, military facilities, etc. Typically, a drop chute method is employed to fill the in-ground storage tank from a fuel source.

FIG. 1 shows a conventional drop chute fuel tank loading arrangement. A fuel truck 1 is coupled trough a loading valve 2 and a loading hose 3 to a conventional drop chute 5 via a pair of quick coupler hose connections 4. The drop chute 5 is inserted into an inlet of the storage tank 6 through a tank sump 7. Typically, the area surrounding the sump 7 and above the tank 6 is concrete 8.

To load fuel using the drop chute method, the storage tank 6 is opened, and the existing fuel level is determined with a graduated stick. The drop chute 5 is inserted into the storage tank 6, and the loading hose 3 is secured to the drop chute 5 and the loading valve 2 via the couplers 4. The loading valve 2 is opened, and the tank is filled to a predetermined level by gravity flow. The loading valve 2 is closed, and the hose 3 is elevated to drain the remaining fuel. The hose 3 is then disconnected from the valve 2 and the drop chute 5, the storage tank 6 is capped, and the loading equipment is stored.

Accidental drips and spills can occur due to faulty equipment and/or human error and carelessness. The couplings may not be properly joined, or the O-rings in the connectors 4 may fail resulting in drips. Carelessness and inattention on the part of the loader may result in a major spill. Still further, if the storage tank 6 is overfilled, the tank sump 7 fills up in a matter of seconds, and if the loader cannot get to the loading valve quickly, the sump 7 will spill over. In this instance, not only is the fuel running onto the ground, but several gallons of fuel remain in the loading hose 3, which presents additional spill potential.

On most occasions, a loader will have three tanks filling simultaneously. A fuel hauling truck has four compartments with a potential to unload three compartments at the same time. This simultaneous unloading in itself also presents a spillage hazard. After a storage tank has been filled and the equipment is uncoupled, a small amount of dripping always occurs at the connectors 4. If the loading hose 3 is not properly elevated and drained, a larger amount of fuel will be spilled.

Stricter Government regulations regarding in-ground tanks are currently being enacted, including some organizations that have declared zero tolerance for waterfront fuel spills of any size. Clean up of small spills and drips cost the industry millions yearly in fines, loss of trucking contracts, labor and cleaning supplies. Thus, there is a need for an effective fuel spill containment apparatus that is portable and easy to install and maintain.

SUMMARY OF THE INVENTION

In accordance with the present invention, a drop chute spill guard is provided that addresses the problems associated with drop chute fuel tank loading. The drop chute spill guard according to the invention includes a flexible barrier sized to surround the tank sump, an absorption layer disposed covering the flexible barrier, and a sealing ring secured to the flexible barrier and having an outside diameter substantially corresponding to the diameter of the sump. An opening disposed in the vicinity of the tank inlet extends through the absorption layer, the flexible barrier and the sealing ring for receiving the drop chute. The absorption layer effectively absorbs any fuel dripped or spilled during the drop chute loading process, and the barrier prevents any absorbed fuel from reaching the ground. By properly positioning the drop chute spill guard according to the invention, the amount of fuel spillage and number of recordable spillage incidents can be greatly reduced if not eliminated entirely.

In accordance with another aspect of the invention, there is provided a drop chute spill guard assembly for containing spills in conjunction with a loading hose supplying fuel to an in-ground storage tank via a drop chute communicating through a sump. The drop chute spill guard includes a flexible barrier sized to surround the sump, a plurality of interchangeable absorption layer inserts adapted to cover the flexible barrier, and a sealing ring secured to the flexible barrier and having an outside diameter substantially corresponding to a diameter of the sump. An opening is disposed in the vicinity of the tank inlet and extends through the flexible barrier and the absorption layer insert thereon and the sealing ring for receiving the drop chute. The spill guard assembly may also include a polyurethane disposal bag to facilitate disposal of used absorption layer inserts. A plurality of absorption towels may also be provided for cleaning the flexible barrier.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
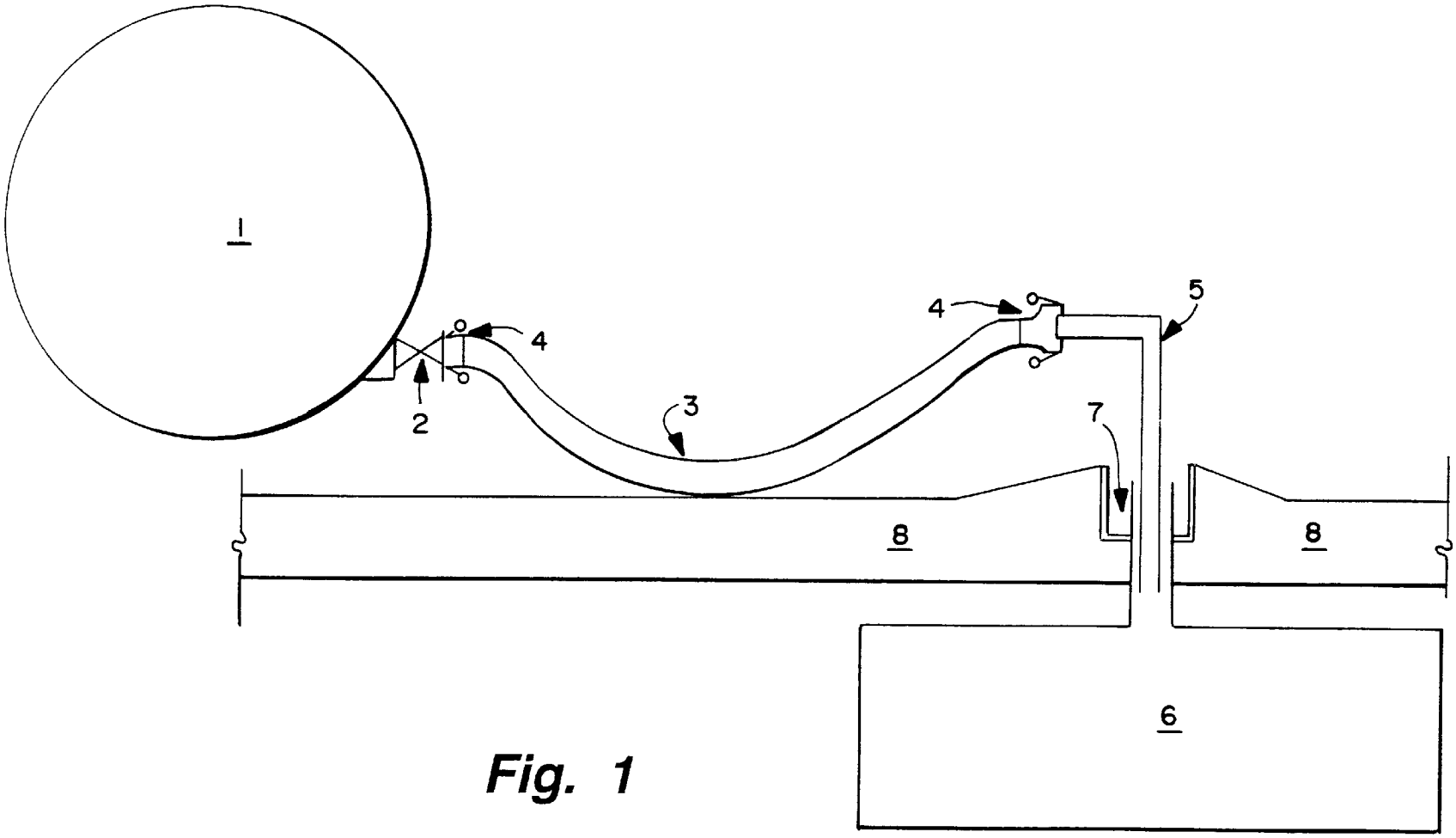
FIG. 1 shows an in-ground tank being loaded with fuel from a fuel truck using the drop chute loading method.
Figure 2:
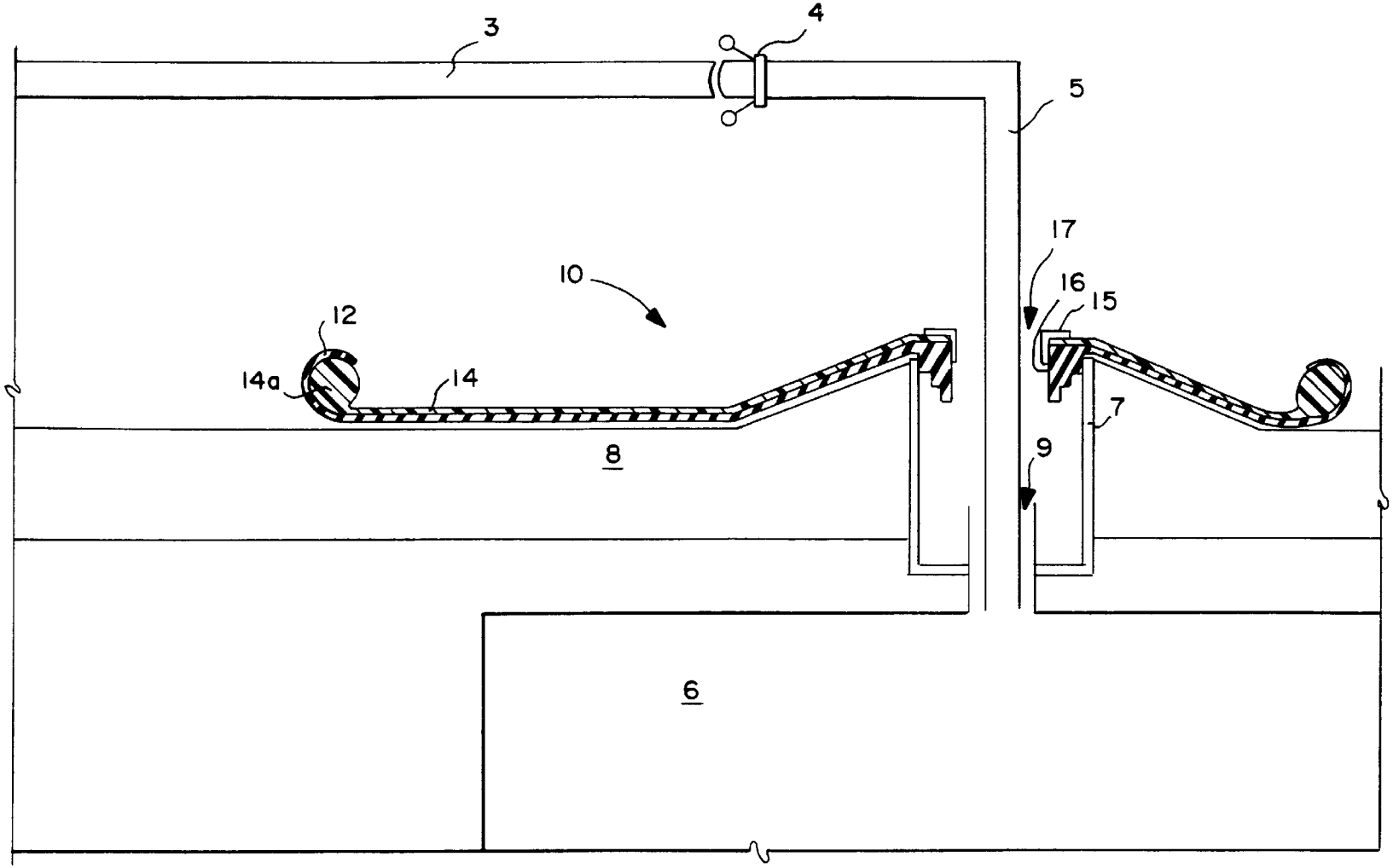
FIG. 2 is a side view of the drop chute spill guard according to the invention positioned for fuel loading.

Referring to FIG. 2, a drop chute spill guard 10 according to the present invention is shown in position engaged with the opening of the sump 7 in the vicinity of the in-ground tank inlet 9. The spill guard 10 includes a barrier 12, an absorption layer 14 disposed covering the barrier 12, and a sealing ring 16 secured to the barrier 12 and having an outside diameter substantially corresponding to a diameter of the sump 7. An opening 17 defined in part by the sealing ring 16 diameter extends through the absorption layer 14 and the barrier 12 for receiving the drop chute. A circular stiffener ring 15 (FIG. 3) is disposed in the opening 17 and press fit over the sealing ring 16. The opening 17 is preferably positioned offset from the spill guard center to maximize the longitudinal length of the spill guard positioned on the side of the sump 7 corresponding to the loading hose 3 and the coupler 4.

The barrier 12 is formed of a flexible material that is resistant to chemical deterioration such as neoprene rubber, preferably about 1/16" thick. The flexibility of the material enables the barrier to readily conform to varying ground contours around the sump 7. The barrier 12 defines the size of the spill guard and should extend as long as practical longitudinally, and as wide as practical subject to portability and storage constraints. In preferred forms, the barrier 12 extends longitudinally at least a distance corresponding to a length of the loading hose 3 and the drop chute 5 and has a width at least as wide as the sump diameter. The barrier, and hence the spill guard, should extend at least beneath the coupling 4 between the loading hose 3 and the drop chute 5 to capture drips from the coupling 4 to beyond the sump 7 to contain spills from overflow.

The absorption layer 14 is preferably formed of polyethylene, which absorbs about 25 times its weight in fuel and will not absorb water. The absorption layer 14 is disposed covering the upper surface of the barrier 12. Absorption layers 14 are manufactured in inserts and are easily removed and replaced. The absorption layer 14 is preferably about ½" thick and is anti-static in nature to decrease the possibility of sudden fire when used in a gasoline application.

Figure 3:
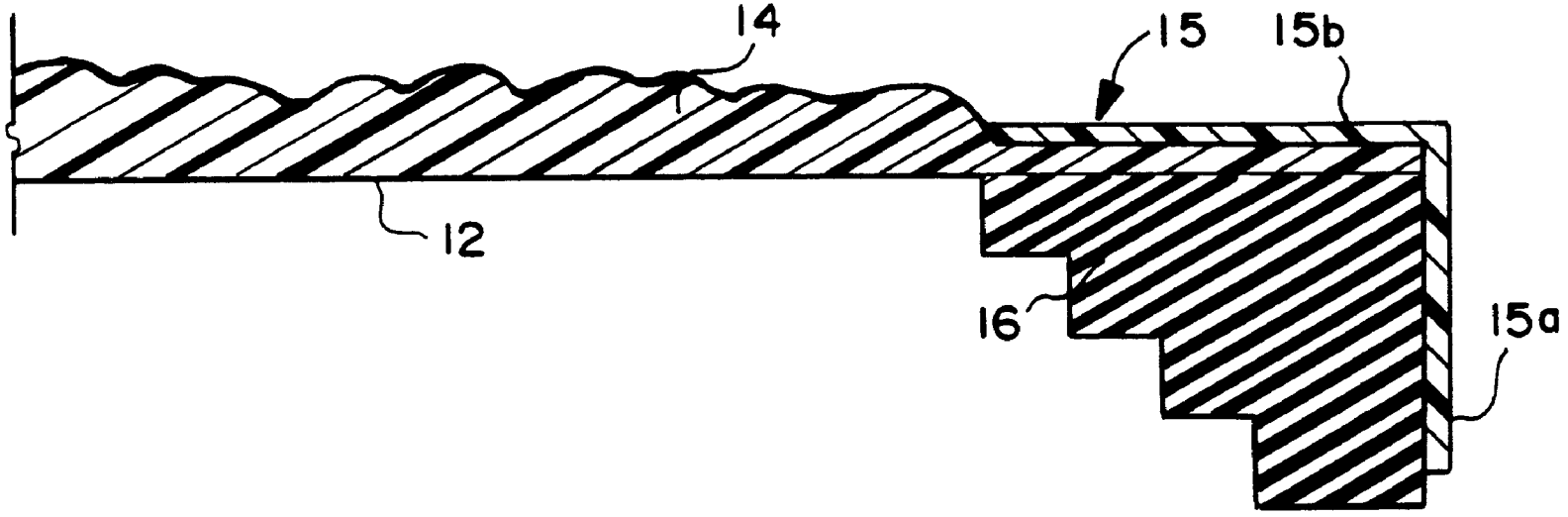
FIG. 3 is a close-up view of the sealing ring and stiffener ring of the present invention.
Figure 4:
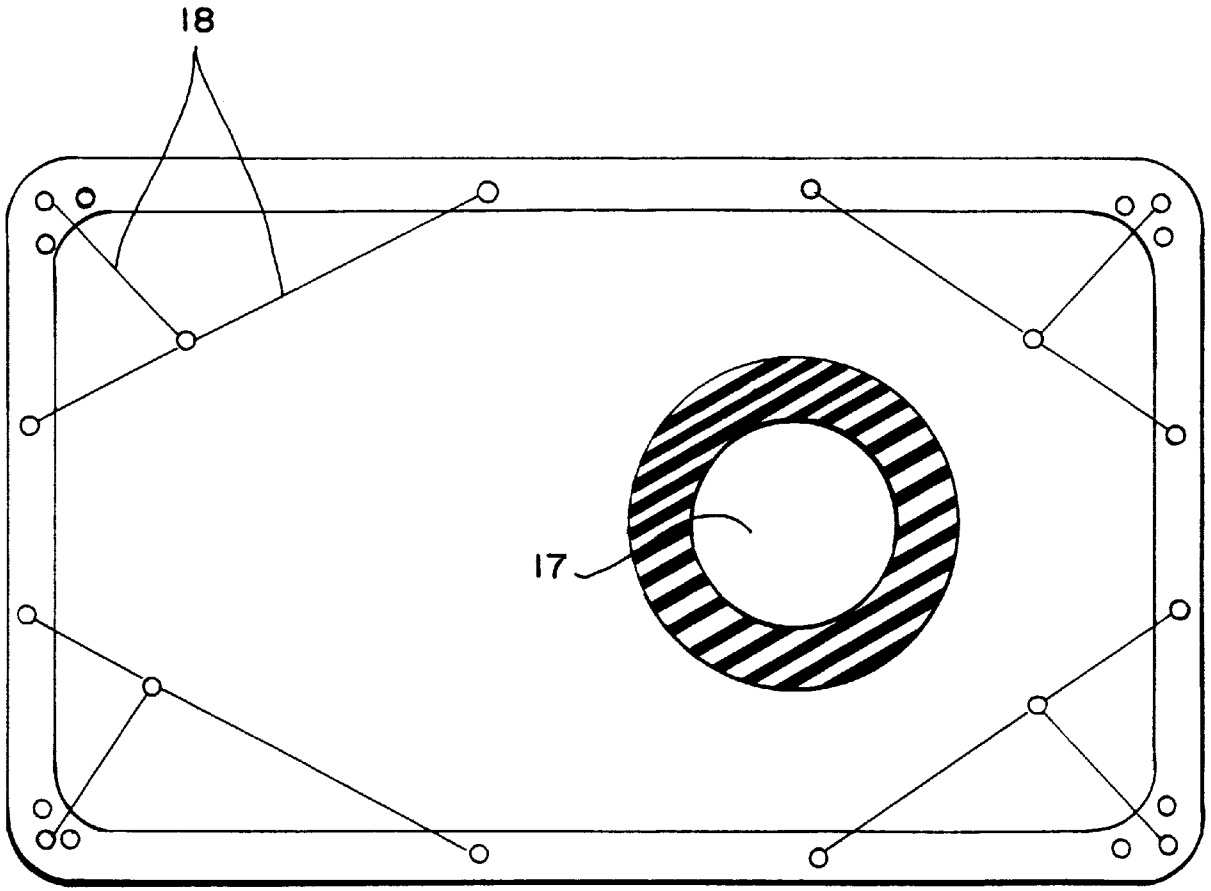
FIG. 4 is a plan view of the drop chute spill guard according to the present invention.

A perimeter of the flexible barrier 12 is folded to define a curved barrier wall. As shown in FIG. 3, a plurality of supporting straps 18 secured by ½" brass compression rivets maintain the folded state of the flexible barrier perimeter. Four straps 18 extend between intermediate portions of adjacent sides of the spill guard, respectively, and an additional strap 18 extends between a spill guard corner and each of the four straps. Those of ordinary skill in the art will contemplate alternative configurations for the straps to achieve the intended purpose, and the invention is not meant to be limited to the illustrated and described arrangement.

The absorption layer 14 is provided with a tubular mass 14*a* about a perimeter thereof As shown in FIG. 2, the tubular mass 14*a* is disposed adjacent the barrier wall. With this structure, the spill guard will easily contain five gallons of fuel on a level surface.

The sealing ring 16 is preferably molded with neoprene and secured to the barrier 12 with an epoxy-based rubber cement. The joined area is about 2 ½" wide over the circumference of the ring. As shown in FIG. 2, an outside diameter of the sealing ring 16 is preferably stepped inward from top to bottom. The stair-step design enables the drop chute spill guard to be used at all storage tanks, which may have varying sump diameters.

The stiffener ring 15 is preferably L-shaped in cross-section as shown in FIG. 3. A first circumferential leg 15*a* sealingly engages the sealing ring 16 in the opening 17. A second circumferential leg 15*b* substantially perpendicular to the first circumferential leg 15*a* is horizontally disposed over a portion of the absorption layer 14 and the sealing ring 16 as shown.

In operation, the spill guard is laid over the sump, and the sealing ring 16 and stiffener ring 15 are firmly hand-pressed into the sump 7. If the tank should run over and the sump 7 fill with fuel, the sealing ring 16 and stiffener ring 15 will channel the fuel to the absorption pad 14 by gravity and keep the fuel from touching the surrounding concrete 8 by virtue of the tight seal between the sealing ring 16 and stiffener ring 15 and the rim of the sump 7. The sealing quality of the neoprene ring 16 and stiffener ring 15 is sufficient to hold the fuel in the sump. The only pressure on the fuel is from gravity flow.

Figure 5:
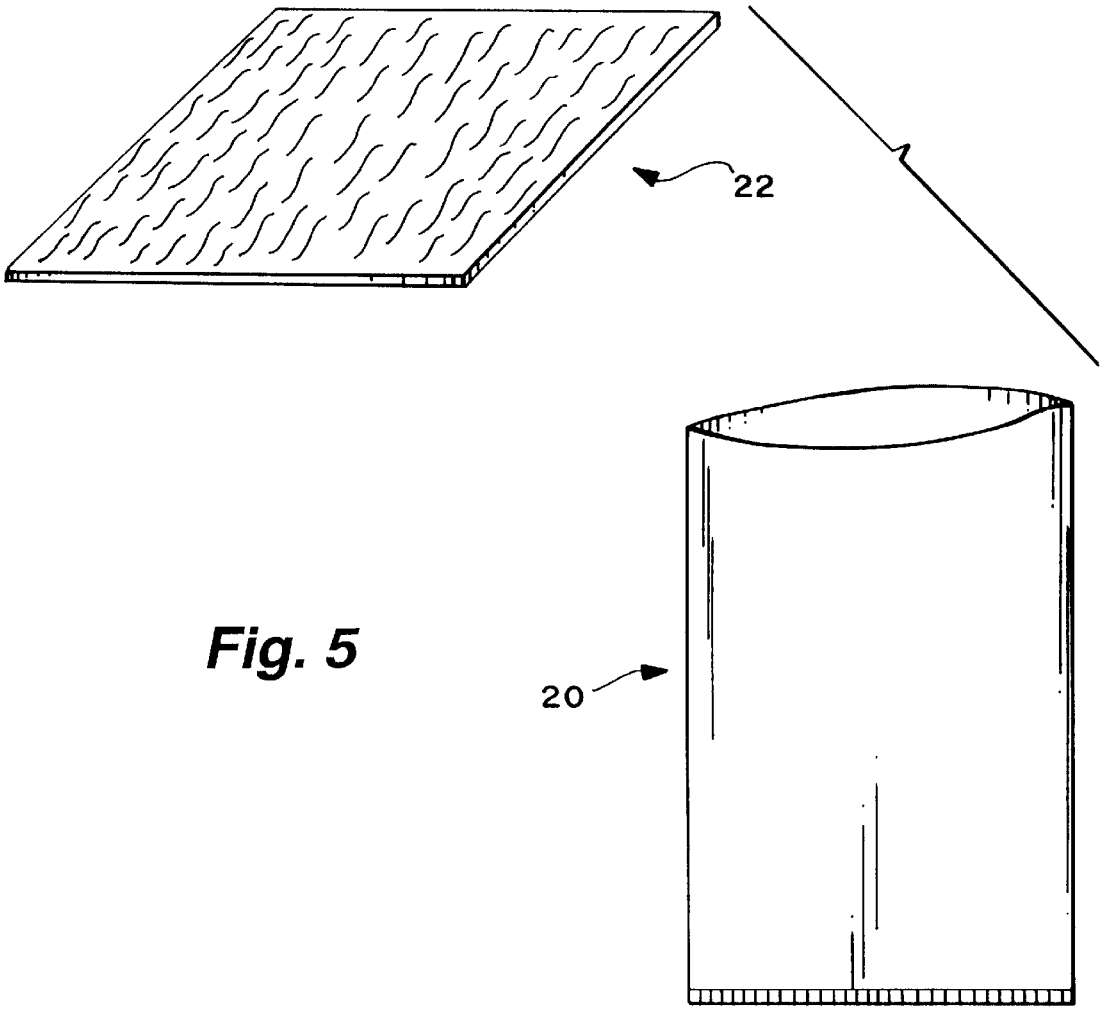
FIG. 5 illustrates a disposal bag and absorption towels used in connection with one aspect of the present invention.

The drop chute spill guard assembly may be provided with a plurality of absorption layer inserts 14 along with a polyurethane disposal bag 20, and a plurality of absorption towels 22 (FIG. 5). In the event of a spill, the sump is emptied, and the contaminated absorption layer insert is carefully removed and placed in the polyurethane disposal bag. The barrier 12 is then blotted dry with absorption towels, cleaned with a degreaser, and rinsed with water. A new absorption layer insert is positioned covering the flexible barrier, and the spill guard is now ready for another application.

By virtue of the spill guard according to the present invention, accidental fuel drips and spills can be effectively contained with a portable and easy to install device. Moreover, when an accidental spill occurs, the absorption layer is easily replaced with an interchangeable absorption layer insert after a brief clean up and the contaminated absorption layer insert can be disposed properly.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A drop chute spill guard for containing spills in conjunction with a loading hose supplying fuel to an in-ground storage tank via a drop chute communicating through a sump, the drop chute spill guard comprising:

a flexible barrier sized to surround the sump and extendible underneath at least a portion of the loading hose;

an absorption layer disposed for covering said flexible barrier wherein said flexible barrier and said absorption layer allow for containing spilled or leaking fuel from the loading hose; and a sealing ring secured to said flexible barrier and having an outside diameter substantially corresponding to a diameter of the sump to thereby form a seals wherein an opening disposed in the vicinity of a tank inlet extends through said absorption layer, said flexible barrier and said sealing ring for receiving the drop chute.

2. A drop chute spill guard according to claim 1, wherein said flexible barrier extends longitudinally at least a distance corresponding to a length of the loading hose and the drop chute and has a width at least as wide as the sump diameter.

3. A drop chute spill guard according to claim 1, wherein said flexible barrier extends longitudinally at least a distance corresponding to a distance between a loading hose coupling and the sump.

4. A drop chute spill guard according to claim 1, wherein said flexible barrier is formed of neoprene rubber.

5. A drop chute spill guard according to claim 1, wherein said absorption layer is formed of polyethylene.

6. A drop chute spill guard according to claim 1, wherein a perimeter of said flexible barrier is folded to define a barrier wall.

7. A drop chute spill guard according to claim 6, wherein said absorption layer comprises a tubular mass about a perimeter thereof, said tubular mass being disposed adjacent said barrier wall.

8. A drop chute spill guard according to claim 6, further comprising a plurality of supporting straps secured to said barrier wall, said supporting straps maintaining said folded state of said flexible barrier perimeter.

9. A drop chute spill guard according to claim 1, further comprising a stiffener ring engaged with said sealing ring and disposed in said opening.

10. A drop chute spill guard according to claim 9, wherein said stiffener ring is substantially L-shaped in cross-section, one leg of the L-shape being sealingly engaged with said sealing ring and the other leg of the L-shape being disposed over a portion of said absorption layer and said sealing ring.

11. A drop chute spill guard according to claim 1, wherein said sealing ring is secured to said flexible barrier with an adhesive.

12. A drop chute spill guard according to claim 11, wherein said adhesive comprises an epoxy-based rubber cement.

13. A drop chute spill guard according to claim 1, wherein an outside diameter of said sealing ring is stepped to accommodate varying sump diameters.

14. A drop chute spill guard assembly for containing spills in conjunction with a loading hose supplying fuel to an in-ground storage tank via a drop chute communicating through a sump, the drop chute spill guard comprising:

a flexible barrier sized to surround the sump and extendible underneath at least a portion of the loading hose;

a plurality of interchangeable absorption layer inserts adapted to cover said flexible barrier, wherein said flexible barrier and said absorption layer allow for containing spilled or leaking fuel from the loading hose; and a sealing ring secured to said flexible barrier and having an outside diameter substantially corresponding to a diameter of the sump to thereby form a seal, wherein an opening disposed in the vicinity of a tank inlet extends through said flexible barrier and absorption layer insert thereon and said sealing ring for receiving the drop chute.

15. A drop chute spill guard assembly according to claim 14, further comprising a polyurethane disposal bag to facilitate disposal of said absorption layer inserts.

16. A drop chute spill guard assembly according to claim 15, further comprising a plurality of absorption towels for cleaning the flexible barrier.

17. A drop chute spill guard assembly according to claim 14, wherein said flexible barrier is formed of neoprene rubber.

18. A drop chute spill guard assembly according to claim 14, wherein said absorption layer inserts are formed of polyethylene.

19. A drop chute spill guard assembly according to claim 14, wherein a perimeter of said flexible barrier is folded to define a barrier wall.

20. A drop chute spill guard assembly according to claim 19, wherein said absorption layer inserts comprise a tubular mass about a perimeter thereof, respectively, said tubular mass being disposable adjacent said barrier wall.

21. A drop chute spill guard assembly according to claim 19, further comprising a plurality of supporting straps secured to said barrier wall, said supporting straps maintaining said folded state of said flexible barrier perimeter.

22. A drop chute spill guard assembly according to claim 14, further comprising a stiffener ring engaged with said sealing ring and disposed in said opening.

23. A drop chute spill guard assembly according to claim 22, wherein said stiffener ring is substantially L-shaped in cross-section, one leg of the L-shape being sealingly engaged with said sealing ring and the other leg of the L-shape being disposed over a portion of said absorption layer and said sealing ring.

* * * * *